US007153530B2

(12) United States Patent
Masek et al.

(10) Patent No.: US 7,153,530 B2
(45) Date of Patent: Dec. 26, 2006

(54) CLOSED CARTRIDGE FOR PREPARING A BEVERAGE FOR EXTRACTION UNDER PRESSURE

(75) Inventors: Petr Masek, Granges (CH); Alain Riesterer, Vevey (CH)

(73) Assignee: Nestec S.A., Vevey (CH)

( * ) Notice: Subject to any disclaimer, the term of this patent is extended or adjusted under 35 U.S.C. 154(b) by 276 days.

(21) Appl. No.: 10/396,557

(22) Filed: Mar. 26, 2003

(65) Prior Publication Data

US 2003/0217643 A1 Nov. 27, 2003

Related U.S. Application Data

(63) Continuation of application No. PCT/EP01/10344, filed on Sep. 6, 2001.

(30) Foreign Application Priority Data

Sep. 26, 2000 (EP) ..... 00120936

(51) Int. Cl.
*B65B 29/02* (2006.01)

(52) U.S. Cl. ..... 426/77; 426/396; 426/433; 426/112; 426/435; 99/295

(58) Field of Classification Search ..... 429/112, 429/433, 77, 435, 396; 99/295
See application file for complete search history.

(56) References Cited

U.S. PATENT DOCUMENTS

| | | | | |
|---|---|---|---|---|
| 2,899,886 | A * | 8/1959 | Rodth | 99/295 |
| 3,843,806 | A * | 10/1974 | Kishpaugh et al. | 426/106 |
| 4,077,876 | A * | 3/1978 | Southall | 210/136 |
| 4,136,202 | A * | 1/1979 | Favre | 426/77 |
| 4,857,053 | A * | 8/1989 | Dalton | 604/288.02 |
| 5,897,899 | A | 4/1999 | Fond | 426/112 |
| 2002/0015768 | A1 * | 2/2002 | Masek et al. | 426/115 |

OTHER PUBLICATIONS

U.S. Appl. No. 10/328,774, filed Dec. 24, 2002.

* cited by examiner

*Primary Examiner*—Milton I. Cano
*Assistant Examiner*—Adepeju O. Pearse
(74) *Attorney, Agent, or Firm*—Bell Boyd & Lloyd LLC

(57) ABSTRACT

The present invention relates to a closed cartridge (10), for extraction under pressure, comprising a dish (12) with a bottom (13 ) with a central part and a peripheral part and a side wall having substantially the shape of a frustum of a cone and a circular edge with a diameter greater at the bottom and a cover (15) welded to the periphery of the edge of the dish and the cover is intended to be torn only through the effect of the force of the extraction fluid when extraction starts, the cartridge comprising, in the dish at the level of the bottom, a fabric (16) guaranteeing retention of the solid substance when it is opened,in which the fabric guaranteeing retention of solid substance is a sheet of fabric sealed in the bottom of the dish in two zones, on the one hand in the central part (17) and on the other hand in the peripheral part (18) of the bottom (13).

4 Claims, 2 Drawing Sheets

CLOSED CARTRIDGE FOR PREPARING A BEVERAGE FOR EXTRACTION UNDER PRESSURE

The present application is a continuation of the U.S. national stage designation of International Application PCT/EP01/10344, filed Sep. 6, 2001, the content of which is expressly incorporated herein by reference thereto.

FIELD OF THE INVENTION

The present invention relates to a sealed cartridge, for extraction under pressure. The cartridge can contain a substance for the preparation of a beverage chosen from ground roasted coffee, tea, instant coffee, a mixture of ground coffee and of instant coffee, a chocolate based product or any other dehydrated edible substance, comprising a dish with a bottom with a central part and a peripheral part and a side wall, having substantially the shape of a frustum of a cone, and a circular edge with a diameter greater at the bottom, and a cover welded to the periphery of the edge of the dish, and the cover is intended to be torn solely upon the effect of the force of the extraction fluid when extraction starts, the said cartridge comprising, in the dish at the level of the bottom, a means guaranteeing retention of the solid substance when it is opened.

BACKGROUND OF THE INVENTION

U.S. patent application Ser. No. 10/328,774, relates to a capsule cage or cartridge, capable of being mounted in a coffee machine, comprising a first part with a channel for the supply of water and a second part forming a housing for the capsule for extraction, in which a perforation system independent of the water-supply channel is provided directly at the exit from the said channel. The cartridge with the means for retention of solid substance, as mentioned above, is insufficient to guarantee complete cleanliness when changing cartridges.

SUMMARY OF THE INVENTION

The present invention can perfect a cartridge provided for the extraction cage as mentioned above and which does not lead to leaks of grounds or of any other solid substance when the said cartridge is changed.

The present invention relates to a closed cartridge in which the means guaranteeing retention of solid substance is a sheet of fabric sealed in the bottom of the dish over two areas, on the one hand in the central part and, on the other hand in the peripheral part of the said bottom. Sealing over the peripheral part of the bottom may be effected over the periphery as a whole or only over a portion of the said periphery. It involves arranging, in each cartridge, a non-return system for the coffee grounds or for any other solid substance extracted in the said cartridge. This system can suit the construction of the extraction head according to U.S. patent application Ser. No. 10/328,774 above.

The fabric used according to the invention has, on the one hand, an acceptable cost and, on the other hand, is simple to produce, allowing easy opening of the capsule by the injection points, being satisfactorily resistant to hot water and providing satisfactory closure after extraction, i.e. when the cartridge is removed.

The fabric used may be any type of fabric, woven or non-woven, made from plastic fibers, from vegetable fibers or from animal fibers. The fabric used is preferably fabric made from polypropylene, polyester, polyurethane, polyamide or cellulose having a thickness of between 15 and 200 microns. The fabric was hot-sealed in the aforesaid two zones in the bottom of the dish.

The cover is heat-welded or crimped to the periphery of the dish. A cartridge which can withstand the pressures which may range up to 15 bar in the extraction system is thereby obtained.

The cartridge is filled with a substance for the preparation of a beverage, as mentioned above. This substance is preferably ground roasted coffee.

"Dish" is understood to include a frustoconical, hemispherical or frustopyramidal element. Naturally, the bottom of the dish does not have to be flat.

The principal body of the cartridge that is shown in FIG. 1, namely the dish, of frustoconical shape and of semi-rigid nature, may consist of a material chosen from aluminum having a thickness of 20 to 100 μm, a pure or multi-layer plastic, a cardboard/aluminum/plastic composite and a cardboard/plastic composite.

The cover of the cartridge, of flexible nature, may be made from a material chosen from aluminum with a thickness of 15 to 60 μm and a multi-layer material comprising either paper of 20 to 60 g/m$^2$, plastic of a thickness of 20 to 60 μm and aluminum with a thickness of 5 to 20 μm, or EVOH or PVDC of a thickness of 5 to 30 μm and plastic (PP, PE or PA) of 20 to 100 μm, or PET (5 to 30 μm) and plastic (PP, PE) of 20 to 100 μm, or PET that is metallized or equipped with a layer which forms an efficient barrier, such as $SiO_2$.

The size of the cartridge according to the invention may vary according to the volume of coffee it is desired to prepare. The measure of coffee may vary between 5 and 20 g, the diameter of the cartridge shown is between 2.5 and 6 cm and the thickness of the bed of coffee between 10 and 40 mm.

An embodiment of the invention is a sealed cartridge, for extraction under pressure, containing a substance for the preparation of a beverage chosen from ground roasted coffee, tea, instant coffee, a mixture of ground coffee and of instant coffee, a chocolate based product or any other dehydrated edible substance, comprising a dish with a bottom with a central part and a peripheral part and a side wall, having substantially the shape of a frustum of a cone, and a circular edge with a diameter greater at the bottom, and a cover welded to the periphery of the edge of the dish, and the cover is intended to be torn only through the effect of the force of the extraction fluid when extraction starts, the said cartridge comprising, in the dish at the level of the bottom, a means guaranteeing retention of the solid substance when it is opened, characterized in that the means guaranteeing retention of solid substance is a sheet of fabric sealed in the bottom of the dish over two areas, on the one hand in the central part and, on the other hand in the peripheral part of the said bottom. The cover is welded or crimped to the edge of the dish. The dish is made from a material chosen from aluminum having a thickness of 20 to 100 μm, a pure or multi-layer plastic, a cardboard/aluminum/plastic composite and a cardboard/plastic composite. The cover is made from a material chosen from aluminum with a thickness of 15 to 60 μm and a multi-layer material comprising either paper of 20 to 60 g/m$^2$, plastic of a thickness of 20 to 60 μm and aluminum with a thickness of 5 to 20 μm, or EVOH or PVDC of a thickness of 5 to 30 μm and plastic (PP, PE or PA) of 20 to 100 μm, or PET (5 to 30 μm) and plastic (PP, PE) of 20 to 100 μm, or PET that is metallized or equipped with a layer which forms an efficient barrier, such as $SiO_2$.

This cartridge has a diameter of between 2.5 and 6 cm and a height of between 10 and 40 mm. The fabric has a thickness of between 15 and 200 microns.

BRIEF DESCRIPTION OF THE DRAWINGS

The remainder of the description is given with reference to the drawings, in which.

DETAILED DESCRIPTION OF THE PREFERRED EMBODIMENTS

Figure 1:
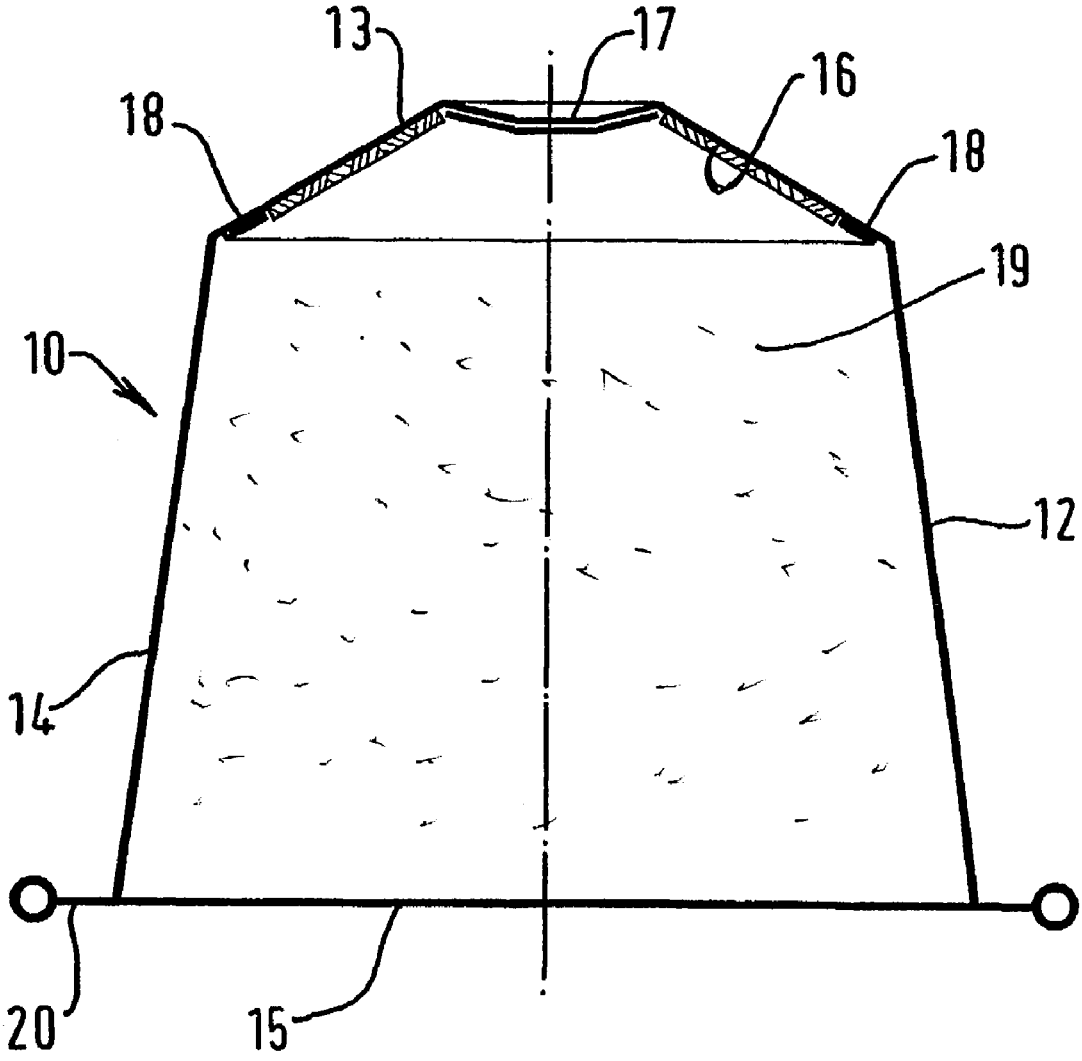
FIG. 1 is a cross-sectional diagrammatic representation of the cartridge according to the invention.

The solution of the invention, according to FIG. 1, is to provide, in the cartridge (10) with a container portion having a dish (12) with bottom (13) and side wall (14), with a circular edge (20) and a cover (15), a layer of fabric (16) made from polyurethane having a thickness of about 60 microns in the bottom (13). This layer is sealed over two zones of the bottom of the dish, namely in the central part or inner zone (17) and in the peripheral part or outer zone (18) of the said bottom. Sealing is effected over the entire periphery of the bottom. The bed of coffee (19) is deposited on the fabric (16). The cartridge shown contains 5 g of coffee and it has a diameter of 35 mm and a coffee-bed thickness of 30 mm. Sealing of the central part is effected over a diameter of the order of 8 mm and that of the peripheral part over a width of the order of 1–2mm.

Figure 2:
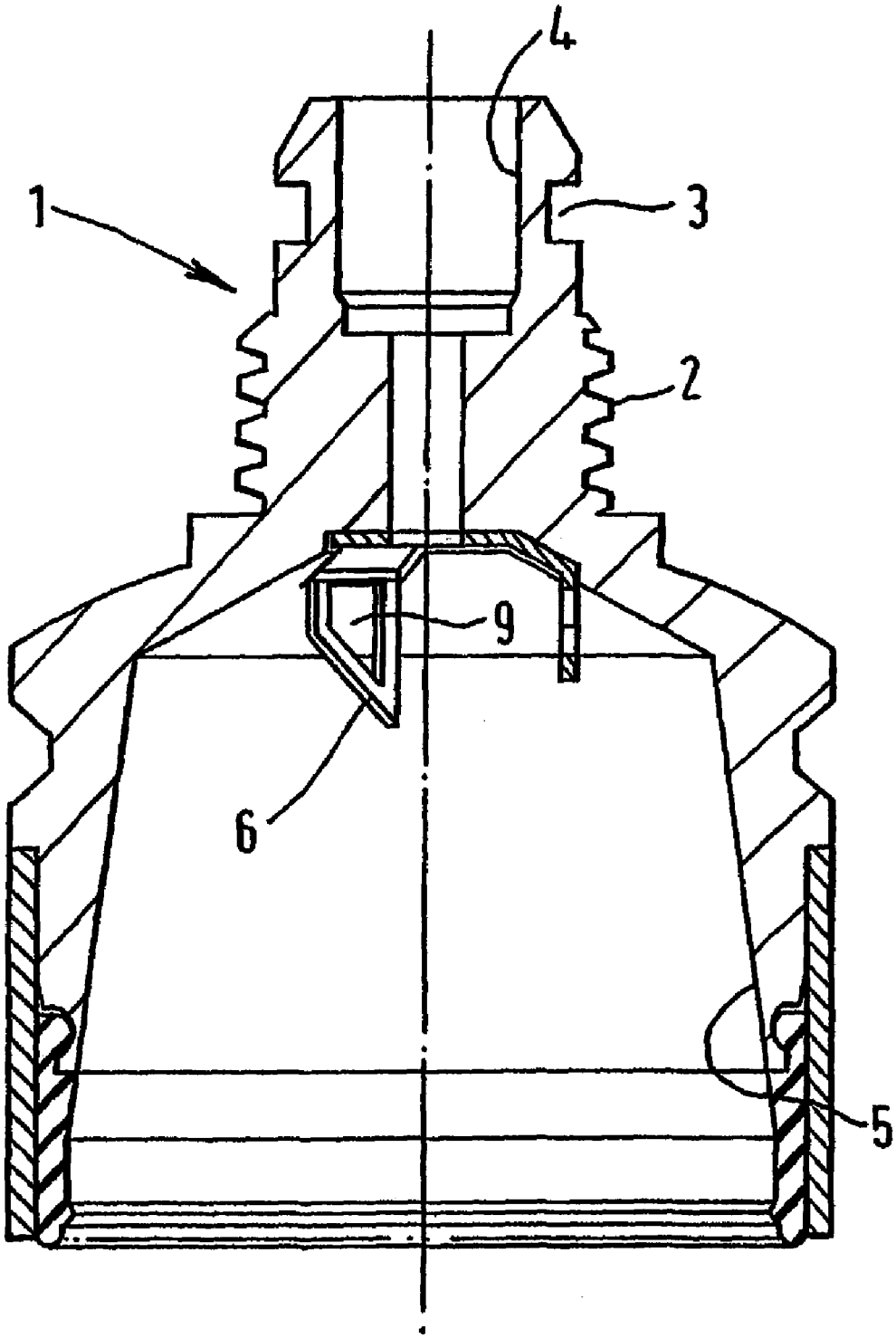
FIG. 2 is a partial section of the capsule cage for the extraction of the cartridge of FIG. 1.

The capsule cage (1) according to FIG. 2 comprises a thread (2) so that it can be screwed onto the coffee machine. The housing (3) is required so that a gasket can be arranged on it, allowing satisfactory sealing of the system. The channel (4) allows the supply of water into the housing (5) of the capsule. Directly at the exit from the channel (4) is the perforation system (6) consisting of three points with apertures (9).

When it is desired to extract the cartridge of FIG. 1, it is placed in the housing (5) of the capsule cage (1). The points (6) will puncture the bottom of the dish and perforate or push back the fabric (16) between the two sealing zones (17) and (18). The advantage of this fabric (16) is that it is resistant to perforation and the water passes through the fabric and, even if the fabric (16) is perforated anyway, at the end of extraction its flexibility and its elasticity enables it to re-close when the points (6) are removed from the cartridge, and the grounds do not emerge via the punctures. A cartridge guaranteeing satisfactory cleanliness of the extraction system is thus provided.

What is claimed is:

1. A method for preparing extracting a food substance from a sealed cartridge for preparing a food, comprising:

puncturing a container portion of the cartridge to open the container portion at least one location with at least one puncture member of an extraction device, wherein the locations are disposed between inner and outer zones along which a solids retention member is attached to the container portion, the outer zone extending around the inner zone, wherein a food product that comprises the food substance and a solid substance is disposed within an interior of the container portion;

injecting an extraction fluid to open another portion of the cartridge for extraction of the food substance from the interior of the container portion; and removing the puncture member from the opening, such that the solids retention member retains the solid substance within the interior of the container portion.

2. The method of claim 1, wherein the solids retention member is punctured by the puncture member and recloses when the puncture member is removed.

3. The method of claim 1, wherein the food is a beverage which is prepared by the extraction.

4. The method of claim 3, wherein the solids retention member comprises a fabric.

* * * * *